US010940532B2

(12) United States Patent
Gong et al.

(10) Patent No.: US 10,940,532 B2
(45) **Date of Patent: *Mar. 9, 2021**

(54) METAL-CERAMIC COMPOSITE STRUCTURE AND FABRICATION METHOD THEREOF

(71) Applicant: BYD COMPANY LIMITED, Shenzhen (CN)

(72) Inventors: Qing Gong, Shenzhen (CN); Xinping Lin, Shenzhen (CN); Yongzhao Lin, Shenzhen (CN); Faliang Zhang, Shenzhen (CN); Bo Wu, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 237 days.

This patent is subject to a terminal disclaimer.

(21) Appl. No.: 15/521,527

(22) PCT Filed: Aug. 28, 2015

(86) PCT No.: PCT/CN2015/088397
§ 371 (c)(1),
(2) Date: Apr. 24, 2017

(87) PCT Pub. No.: WO2016/062163
PCT Pub. Date: Apr. 28, 2016

(65) Prior Publication Data

US 2017/0312817 A1 Nov. 2, 2017

(30) Foreign Application Priority Data

Oct. 24, 2014 (CN) ..... 201410579014.3

(51) Int. Cl.

| | |
|---|---|
| ***B22D 19/02*** | (2006.01) |
| ***C22C 16/00*** | (2006.01) |
| ***C22C 32/00*** | (2006.01) |
| ***B22F 7/08*** | (2006.01) |
| ***C22C 45/10*** | (2006.01) |
| ***C22C 1/10*** | (2006.01) |
| ***C22C 1/05*** | (2006.01) |
| ***B22D 17/00*** | (2006.01) |
| ***B28B 11/12*** | (2006.01) |
| ***B28B 11/24*** | (2006.01) |
| ***B22D 19/00*** | (2006.01) |
| ***B22F 7/06*** | (2006.01) |
| ***C22F 1/18*** | (2006.01) |

(52) U.S. Cl.

CPC ..... *B22D 19/02* (2013.01); *B22D 17/00* (2013.01); *B22D 19/00* (2013.01); *B22F 7/062* (2013.01); *B22F 7/08* (2013.01); *B28B 11/12* (2013.01); *B28B 11/243* (2013.01); *C22C 1/05* (2013.01); *C22C 1/053* (2013.01); *C22C 1/058* (2013.01); *C22C 16/00* (2013.01); *C22C 32/0047* (2013.01); *C22C 32/0052* (2013.01); *C22C 45/10* (2013.01); *C22F 1/186* (2013.01); *B22F 2998/10* (2013.01); *B22F 2999/00* (2013.01); *C22C 1/1068* (2013.01)

(58) Field of Classification Search

CPC ..... C22C 1/0458; C22C 1/002; C22C 16/00; C22C 1/053; C22C 32/052; C22C 32/0047; C22C 32/0052; C22C 45/10; B22D 19/02; B32B 9/005; B32B 9/041; B32B 15/04; B32B 3/06; B32B 3/08; B32B 3/266; B32B 3/30

See application file for complete search history.

(56) References Cited

U.S. PATENT DOCUMENTS

| | | | | |
|---|---|---|---|---|
| 7,320,832 | B2 * | 1/2008 | Palumbo | A01K 87/00 428/548 |
| 2010/0028699 | A1 | 2/2010 | Lenk et al. | |
| 2011/0174661 | A1 * | 7/2011 | Chen | C04B 41/009 206/524.3 |
| 2011/0174671 | A1 * | 7/2011 | Chen | C23C 14/0015 206/524.6 |

(Continued)

FOREIGN PATENT DOCUMENTS

| | | | |
|---|---|---|---|
| CN | 87101811 | A | 9/1987 |
| CN | 1061585 | A | 6/1992 |

(Continued)

OTHER PUBLICATIONS

James, Review Article: A review of measurement techniques for the thermal expansion coefficient of metals and alloys at elevated temperatures, 2001, Measurement Science and Technology, vol. 12, R1-R15. (Year: 2001).*

Thermal expansion, Wikipedia.org, retrieved on Sep. 28, 2019 from "https://en.wikipedia.org/w/index.php?title=Thermal_expansion&oldid=917733128" (Year: 2019).*

Repalle, Evaluation of Coefficient of Thermal Expansion of Zirconium by Using Dilatometer & ANSYS, 2018, Advanced Materials Research, vol. 1148, pp. 128-135. (Year: 2018).*

The World Intellectual Property Organization (WIPO) International Search Report for PCT/CN2015/088397 dated Dec. 10, 2015 6 Pages.

*Primary Examiner* — Monique R Jackson

(74) *Attorney, Agent, or Firm* — Anova Law Group, PLLC

(57) ABSTRACT

The present disclosure provides a metal-ceramic composite structure and a fabrication method thereof. The metal-ceramic composite structure includes a ceramic substrate having a groove on a surface thereof; a metal member filled in the groove, including a main body made of zirconium base alloy, and a reinforcing material dispersed in the main body and selected from at least one of W, Mo, Ni, Cr, stainless steel, WC, TiC, SiC, ZrC, $ZrO_2$, BN, $Si_3N_4$, TiN and $Al_2O_3$; a luminance value L of the metal member surface is in a range of 36.92-44.07 under a LAB Chroma system.

5 Claims, No Drawings

(56) References Cited

U.S. PATENT DOCUMENTS

| | | | | |
|---|---|---|---|---|
| 2011/0177357 | A1* | 7/2011 | Chen | C23C 14/0015 428/615 |
| 2013/0032254 | A1* | 2/2013 | Waniuk | C22C 45/10 148/538 |
| 2015/0202841 | A1* | 7/2015 | Verreault | B32B 15/01 428/649 |
| 2015/0344993 | A1* | 12/2015 | Derrig | A44C 27/003 63/15 |
| 2015/0344999 | A1* | 12/2015 | Na | C22F 1/14 148/538 |

FOREIGN PATENT DOCUMENTS

| | | | | |
|---|---|---|---|---|
| CN | 1701052 | A | 11/2005 | |
| CN | 101709421 | A | 5/2010 | |
| CN | 101740425 | A | 6/2010 | |
| CN | 101631883 | B | 3/2012 | |
| CN | 102618772 | A | 8/2012 | |
| CN | 102633488 | A | 8/2012 | |
| CN | 102912173 | A | 2/2013 | |
| CN | 103641487 | A | 3/2014 | |
| EP | 0238321 | A1 | 9/1987 | |
| EP | 2450132 | A2 | 5/2012 | |
| EP | 2989067 | A1 | 3/2016 | |
| JP | 01113161 | A | 5/1989 | |
| JP | H01113161 | A | 5/1989 | |
| JP | H05148067 | A | 6/1993 | |
| JP | H0687669 | A | 3/1994 | |
| JP | 2012246173 | A | 12/2012 | |
| WO | WO-2014173321 | A1 * | 10/2014 | C04B 41/009 |

* cited by examiner

METAL-CERAMIC COMPOSITE STRUCTURE AND FABRICATION METHOD THEREOF

CROSS REFERENCE TO RELATED APPLICATIONS

This application is a national stage application of PCT Application No. PCT/CN2015/088397, filed on Aug. 28, 2015, which claims priority and benefits of Chinese Patent Application No. 201410579014.3, filed with State Intellectual Property Office on Oct. 24, 2014, the entire contents of the above identified applications are incorporated herein by reference.

FIELD OF THE INVENTION

The present disclosure relates to a metal-ceramic composite material field, especially relates to a metal-ceramic composite structure and a fabrication method to make the same.

BACKGROUND INFORMATION

Metal-ceramic composite wear-resisting material is mainly applied as a wear-resisting component, such as a roll sleeve, a lining board, a grinding ring or a grinding disc, in a material crushing or a grinding equipment in a field of metallurgy, building materials, mine, fire-resisting material and electric power, etc. Such metal-ceramic composite wearing-resisting material is produced to meet a requirement of high wear resistance. A performance of the metal-ceramic composite component depends on a performance of the metal, a performance of the ceramic, and a combining strength between them. The metal-ceramic composite component has been applied in many fields because of its good performance. For example, a ceramic article with metal decoration simultaneously having a whole mirror effect of ceramic and a matt effect of metal has been produced in the related art, and is widely used due to its good wear-resisting performance.

Currently, the method for preparing a ceramic-metal composite component mainly includes powder metallurgy process, co-spray deposition forming process, stirring and mixing process, extrusion casting process and in-situ formation process and so on. The current preparing technology is complicated and has a high cost; a location and a volume percentage of the ceramic in the ceramic-metal composite component are difficult to control; and the distribution of the ceramic is not even. The volume ratio of the ceramic to the metal and the distribution condition of the ceramic in the composite component are not able to well ensure a good comprehensive performance and wear-resisting performance. Thus, a method was proposed to firstly carry out a pretreatment and a surface activation treatment to a zirconia-alumina multiphase ceramic, and fix it in a casting mold, then to pour high temperature steel metal melt adopting casting technology. But the composite component prepared by this method has pores inside, and the appearance of the composite component is influenced, so that the composite component cannot be used as an appearance part.

The ceramic article with metal decoration is usually prepared by depositing metal adopting PVD (Physical Vapor Deposition) technology, but the metal layer obtained is very thin and has a low bonding force with the ceramic substrate, the metal decoration is easy to be abraded. A rate of good products is low, and the application is limited.

SUMMARY

The present disclosure aims to solve the problems in above existing metal-ceramic composite structure, that is, the metal member thereof has a low hardness, the bonding force between the metal member and the ceramic substrate is weak, and the whole appearance is poor.

The solution to solve the above problems adopted by present disclosure is as follows:

A first aspect of present disclosure provides a metal-ceramic composite structure, which includes a ceramic substrate having a groove on its surface; a metal member filled in the groove, the metal member includes a main body made of zirconium base alloy and a reinforcing material dispersed in the main body; the reinforcing material is selected from at least one of W, Mo, Ni, Cr, stainless steel, WC, TiC, SiC, ZrC, $ZrO_2$, BN, $Si_3N_4$, TiN and $Al_2O_3$. A luminance value L of the metal member surface is in a range of 36.92-44.07 under a LAB Chroma system. In other words, the metal-ceramic composite structure includes a ceramic substrate and a metal member, the ceramic substrate has a groove on a surface thereof, and the metal member is disposed in the groove; the metal member includes a zirconium base alloy and a reinforcing material dispersed in the zirconium base alloy, the reinforcing material is selected from at least one of W, Mo, Ni, Cr, stainless steel, WC, TiC, SiC, ZrC, $ZrO_2$, BN, $Si_3N_4$, TiN and $Al_2O_3$; a luminance value L of the metal member surface is in a range of 36.92-44.07 under a LAB Chroma system.

A second aspect of present disclosure provides a fabrication method of above metal-ceramic composite structure, including the following steps: S1: providing a ceramic substrate having a groove on its surface; S2: preparing a metal melt including a molten zirconium base alloy and a reinforcing material, the reinforcing material is selected from at least one of W, Mo, Ni, Cr, stainless steel, WC, TiC, SiC, ZrC, $ZrO_2$, BN, $Si_3N_4$, TiN and $Al_2O_3$; S3: filling the metal melt in the groove; S4: solidifying the metal melt to form a metal member, and the metal-ceramic composite structure is obtained. In other words, the fabrication method of above metal-ceramic composite structure includes: firstly, add a reinforcing material to a molten zirconium base alloy, and mix evenly under an inactive atmosphere, so as to obtain a metal melt; based on a total volume of the metal member, a volume percentage of the reinforcing material is below 30%; the reinforcing material is selected from at least one of W, Mo, Ni, Cr, stainless steel, WC, TiC, SiC, ZrC, $ZrO_2$, BN, $Si_3N_4$, TiN and $Al_2O_3$; and secondly, provide a ceramic substrate having a groove on a surface thereof; fill the metal melt in the groove; then the metal-ceramic composite structure is obtained after cooling.

In some embodiments of present disclosure, a bonding force between the metal member and the ceramic substrate is more than 50 MPa (shear strength) and, thus, the bonding force is strong. A surface hardness of the metal member is great (more than 500 Hv), so it is not easily to be abraded, and has a good corrosion resistance at the same time. In addition, there is no defection such as pores in the metal-ceramic composite structure, whilst a luminance value L of the metal member surface is in a range of 36.92-44.07 under a LAB Chroma system, the brightness is high, and the appearance is good.

DETAILED DESCRIPTION

Reference will be made in detail to embodiments of the present disclosure. The embodiments described herein are explanatory, illustrative, and used to generally understand the present disclosure. The embodiments shall not be construed to limit the present disclosure.

The first aspect of present disclosure provides a metal-ceramic composite structure, which includes a ceramic substrate having a groove on a surface thereof, and a metal member which is filled in the groove, the metal member includes: a main body made of zirconium base alloy and a reinforcing material dispersed in the main body, the reinforcing material is selected from at least one of W, Mo, Ni, Cr, stainless steel, WC, TiC, SiC, ZrC, $ZrO_2$, BN, $Si_3N_4$, TiN and $Al_2O_3$; and a luminance value L of the metal member surface is in a range of 36.92-44.07 under a LAB Chroma system. In other words, the metal-ceramic composite structure includes a ceramic substrate and a metal member; there is a groove on a surface of the ceramic substrate, the metal member is filled in the groove; the metal member includes a zirconium base alloy and a reinforcing material dispersed in the zirconium base alloy, the reinforcing material is selected from at least one of W, Mo, Ni, Cr, stainless steel, WC, TiC, SiC, ZrC, $ZrO_2$, BN, $Si_3N_4$, TiN and $Al_2O_3$; and the metal member has a surface luminance value L in a range of 36.92-44.07 under a LAB Chroma system.

In some embodiments of the present disclosure, the metal-ceramic composite structure has a high brightness and a good appearance when the luminance value L of the metal member surface is in a range of 36.92-44.07, and it can solve the problem of the appearance of an existing metal-ceramic composite structure is not ideal. In the meantime, through adding the reinforcing material in the metal member, it not only can effectively improve a mechanical property and increase a mechanical strength of the metal member, but also effectively reduces a wetting angle between the metal member and the ceramic substrate, effectively increasing the bonding force between the metal member and the ceramic substrate.

In some embodiments of the present disclosure, in the metal-ceramic composite structure mentioned above, the ceramic substrate is a main part. Specifically, there is no limitation to the ceramic substrate in the present disclosure, it can be all kinds of ceramic substrate as known by the skilled person in this field. Optionally, the present disclosure adopts the ceramic substrate having a thermal expansion coefficient of $7-10\times10^{-6}K^{-1}$. Further, the ceramic substrate is made of zirconia ceramic, the zirconia ceramic is not only capable of combining with the reinforcing material better, but also has a high toughness, so it is good for further optimizing the property of the metal-ceramic composite structure.

In some embodiments of the present disclosure, the surface of the ceramic substrate is provided with a groove used to hold the metal member. Ordinarily, an area of the groove is small, a pattern formed by the groove can be used as a decoration or a logo. The metal member is filled in the groove, forming a special pattern, and replacing the ceramic in color and luster, showing a mirror effect of the ceramic and a matt effect of the metal, so the metal-ceramic composite structure has a desired overall appearance.

In some embodiments of the present disclosure, a size of the groove can change in a large range, and it can be determined by the skilled person in this field according to an actual requirement. In order to provide an excellent bonding force and a performance of resisting cold and heat impact, optionally, a depth of the groove is at least 0.1 mm. In other words, the depth of the groove is more than 0.1 mm.

In some embodiments of the present disclosure, in the metal-ceramic composite structure mentioned above, the metal member is held in the groove on the surface of the ceramic substrate, having a decorative effect. The metal member includes a main body made of zirconium base alloy and a reinforcing material dispersed in the main body. In other words, the metal member includes a zirconium base alloy and a reinforcing material in the zirconium base alloy.

In some embodiments of the present disclosure, optionally the thermal expansion coefficient of the zirconium base alloy is in a range of $9\times10^{-6}K^{-1}-15\times10^{-6}K^{-1}$, and it is preferred to use well-known zirconium base amorphous alloy in the related art.

In some embodiments of the present disclosure, the aforementioned zirconium base alloy can be used as a binder, greatly improving a combining strength between the metal member and the ceramic substrate. In addition, the bonding force between the metal member which includes a zirconium base alloy as well as a reinforcing material and the ceramic substrate is much higher than the bonding force between a pure zirconium base alloy and the ceramic substrate. Meanwhile, the strength and the hardness of the metal member having the reinforcing material are also improved in contrast to a pure zirconium base alloy. When the ceramic substrate is a zirconia ceramic, adopting zirconium base amorphous alloy is good for furtherly improving the bonding force and the performance of resisting cold and heat impact between the metal member and the ceramic substrate.

In some embodiments of the present disclosure, the reinforcing material mentioned above is dispersed in the zirconium base alloy. The reinforcing material is specifically selected from at least one of the W, Mo, Ni, Cr, stainless steel, WC, TiC, SiC, ZrC, $ZrO_2$, BN, $Si_3N_4$, TiN and $Al_2O_3$.

In some embodiments of the present disclosure, the reinforcing material has a particle shape, and a D50 particle size of the reinforcing material is 0.1 μm-100 μm. In some embodiments of the present disclosure, the reinforcing material is evenly dispersed in the zirconium base alloy.

A melting point of all the reinforcing material adopted by the present disclosure is higher than ordinary zirconium base alloy (for example, a melting point of W is 3410° C., a melting point of Mo is 2610° C.), and it is good for effective combination between the zirconium base alloy and the reinforcing material in a preparing process. Especially, when the zirconium base alloy is a zirconium base amorphous alloy, for example, the material of W and Mo and so on has a good wettability with the zirconium base amorphous alloy, it is furtherly beneficial to effectively combine the zirconium base amorphous alloy with the reinforcing material.

In addition, the reinforcing material is dispersed in the zirconium base alloy, it can effectively avoid the zirconium base alloy (especially the zirconium base amorphous alloy) formed in a large area, so as to avoid pores formed in the metal member, making the metal member have a high appearance quality, and the metal member is more suitable to be used as an appearance part, having wide application scope.

In some embodiments of the present disclosure, optionally, a thermal expansion coefficient of the reinforcing material is in a range of $3\times10^{-6}K^{-1}-10\times10^{-6}K^{-1}$. Especially on the condition of a thermal expansion coefficient of the ceramic substrate is $7\times10^{-6}K^{-1}-10\times10^{-6}K^{-1}$ and a thermal expansion coefficient of the zirconium base alloy is $9\times10^{-6}K^{-1}-15\times10^{-6}K^{-1}$, the thermal expansion coefficient of the metal member obtained by compounding the reinforcing material mentioned above and the zirconium base alloy mentioned above is close to the thermal expansion coefficient of the ceramic substrate mentioned above, so it can effectively avoid the thermal mismatch between the ceramic substrate and the metal member, and improve the performance of resisting cold and heat impact.

The metal-ceramic composite structure is usually expected to have an excellent appearance property. According to the metal-ceramic composite structure of present disclosure, a luminance value L of the metal member surface is in a range of 36.92-44.07 under a LAB Chroma system, and the metal member having above luminance value L cooperates with the ceramic substrate, giving an excellent appearance to the metal-ceramic composite structure.

According to some embodiments of the present disclosure, in the metal-ceramic composite structure, the luminance value L of the metal member surface in the above range can be ensured by controlling a content of the reinforcing material less than 30% (a volume percentage based on a total volume of the metal member) in the metal member.

In some embodiments of the present disclosure, optionally, based on the total volume of the metal member, a volume percentage of the reinforcing material is in a range of 5%-30%, so as to achieve the metal member having high brightness, whilst having high hardness, and the bonding force between the metal member and the ceramic substrate is strong.

The second aspect of present disclosure provides a fabrication method of the metal-ceramic composite structure, including the following steps: S1: providing a ceramic substrate having a groove on its surface: S2: providing a metal melt comprising a molten zirconium base alloy and a reinforcing material, the reinforcing material is selected from at least one of W, Mo, Ni, Cr, stainless steel, WC, TiC, SiC, ZrC, $ZrO_2$, BN, $Si_3N_4$, TiN and $Al_2O_3$; S3: filling the metal melt in the groove; S4: solidifying the metal melt to form a metal member, so as to obtain the metal-ceramic composite structure. In other words, the preparing method of the metal-ceramic composite structure includes: Firstly, adding a reinforcing material to a molten zirconium base alloy, and evenly mixing under an inactive atmosphere, so as to obtain a metal melt; based on a total volume of the metal member, a volume percentage of the reinforcing material is less than 30%; the reinforcing material is selected from at least one of W, Mo, Ni, Cr, stainless steel, WC, TiC, SiC, ZrC, $ZrO_2$, BN, $Si_3N_4$, TiN and $Al_2O_3$. Secondly, providing a ceramic substrate which has a groove on a surface thereof; filling the above metal melt in the groove; and then the metal-ceramic composite structure is obtained after cooling.

In some embodiments of the present disclosure, the reinforcing material needs to be evenly mixed in the zirconium base alloy melt.

A thermal expansion coefficient of the above zirconium base alloy can be in a range of $9\times10^{-6}K^{-1}$–$15\times10^{-6}K^{-1}$ in present disclosure, and it can be all kinds of the zirconium base alloy in the related art. Optionally, the zirconium base alloy is a zirconium base amorphous alloy, for example a series of ZrAlCuNi amorphous alloy. Therefore, the metal member formed not only has a good mechanical performance, such as hardness, strength, a performance of resisting cold and heat impact and so on, but also has a strong bonding force with the ceramic substrate.

In some embodiments of the present disclosure, the reinforcing material is selected from at least one of W, Mo, Ni, Cr, stainless steel, WC, TiC, SiC, ZrC, $ZrO_2$, BN, $Si_3N_4$, TiN and $Al_2O_3$, optionally, the reinforcing material has a particle shape, a particle size thereof can change in a large range, for example, a D50 particle size of the reinforcing material is in a range of 0.1 μm-100 μm.

In some embodiments of the present disclosure, the reinforcing material can be particles of a single material, and it can also adopt the particles of several materials mentioned above. Similarly, the reinforcing material can be the particles of the same particle size, and also can be the particles of different particle size together.

In some embodiments of the present disclosure, optionally, a thermal expansion coefficient of the reinforcing material is in a range of $3\times10^{-6}K^{-1}$–$10\times10^{-6}K^{-1}$.

In some embodiments of the present disclosure, the alloy used for preparing the metal member is a zirconium base alloy, the the zirconium base alloy melt has a good wettability with the reinforcing material such as W, Mo and so on, and it can contact with the reinforcing material effectively in a short time. Meanwhile, the reinforcing material such as W, Mo and so on has a low solubility in the zirconium base alloy melt, stability of an alloy phase composition of the zirconium base alloy melt can be ensured, and performance of the metal member can be furtherly guaranteed.

In some embodiments of the present disclosure, a melting point of the reinforcing material is higher than a melting point of the zirconium base alloy, so the reinforcing material would not be melted in the zirconium based alloy melt, in the subsequent cooling process, it can effectively avoid to form a large area of the zirconium base alloy melt, thus reducing the probability of the pores emerging on the surface of prepared metal member, which is good for improving the appearance quality of the metal member.

In addition, a C (carbon) element in the reinforcing material such as WC, TiC, SiC, ZrC and so on may react with Zr element in the zirconium base alloy to form a ZrC, so as to improve the bonding force between the zirconium base alloy melt and the reinforcing material. And the aforementioned reaction mainly occurs on an interface between the reinforcing material and the zirconium base alloy melt, it can also improve the wettability of the reinforcing material and the zirconium base alloy melt, so the zirconium base alloy melt can be better combined with the reinforcing material, and the performance of the metal-ceramic composite structure can be optimized.

In some embodiments of the present disclosure, the metal melt is prepared by mixing the reinforcing material and the molten zirconium-based alloy at a temperature of 900-1100° C. In order to ensure a surface brightness of the prepared metal member in a range of present disclosure, a content of the reinforcing material should be guaranteed within a special range when mixing the reinforcing material and the molten zirconium base alloy. Specifically, based on a total volume of the metal member, or to get a total volume of the metal member as a benchmark, the amount of the reinforcing material is required to ensure that a volume percentage of the reinforcing material is less than 30% in the prepared metal member. Optionally, based on a total volume of the metal member, the volume percentage of the reinforcing material is more than 5% and less than 30%. Thus, a high brightness and a high hardness of the metal member can be achieved, and a strong bonding force between the metal member and the ceramic substrate can also be achieved.

It is understood that, in the present disclosure, although the volume of the zirconium base alloy melt will change after it has been cooled, because the change amount is very small, the difference of the volume change in the present disclosure is negligible. Therefore, in the preparing process of the present disclosure, the volume of the zirconium base alloy melt is equivalent to the volume of the zirconium base alloy in the metal member. When preparing the metal melt and adding reinforcing material therein, it only needs to guarantee the ratio of the volume of the reinforcing material to the total volume of the reinforcing material and the zirconium base alloy melt is in the range mentioned above.

In some embodiments of the present disclosure, after adding the reinforcing material to the zirconium base alloy melt, it needs to mix them, so the reinforcing material can be dispersed evenly in zirconium base alloy melt.

In some embodiments of the present disclosure, the metal melt is obtained by mixing the reinforcing material and the molten zirconium base alloy under a protective atmosphere. That is, the mixing process mentioned above proceeds under a protective atmosphere. As known in the related art, the protective atmosphere can be a vacuum situation or an inactive gas situation (such as nitrogen atmosphere or argon atmosphere).

In order to avoid cooling of the zirconium base alloy melt in the process of preparing the metal melt, optionally, the mixing process proceeds at a temperature range of 900-1100°C.

In some embodiments of the present disclosure, a thermal expansion coefficient of the ceramic substrate is in a range of $7\times10^{-6}K^{-1}-10\times10^{-6}K^{-1}$.

Specifically, when the thermal expansion coefficient of the aforementioned ceramic substrate is in a range of $7\times10^{-6}K^{-1}-10\times10^{-6}K^{-1}$, the thermal expansion coefficient of the zirconium base alloy is in a range of $9\times10^{-6}K^{-1}-15\times10^{-6}K^{-1}$ and the thermal expansion coefficient of the reinforcing material is in a range of $3\times10^{-6}K^{-1}-10\times10^{-6}K^{-1}$, then the thermal expansion coefficient of the metal member prepared by mixing the reinforcing material and the zirconium base alloy is close to the thermal expansion coefficient of the ceramic substrate, so that a thermal mismatch between the ceramic substrate and the metal member can be effectively avoided, and a performance of resisting cold and heat impact of the metal-ceramic composite structure is improved.

Specifically, the ceramic substrate is preferably made of zirconia ceramic.

In some embodiments of the present disclosure, the surface of the ceramic substrate used to prepare the metal-ceramic composite structure has a groove. The pattern of the above groove can be a shape of a decoration or a sign need to be formed. It can be understood that, the ceramic substrate having a groove can be obtained through commercial purchase or being self-prepared. According to some embodiments of present disclosure, the ceramic substrate is prepared by the following steps: S11, preforming a ceramic green body having a groove; S12, sintering the ceramic green body to obtain the ceramic substrate.

Specifically, forming a convex pattern corresponding to the groove pattern of the ceramic substrate in advance on a mold used in injection molding or hot injection molding, the ceramic green body having a groove pattern is obtained using a method of traditional injection molding or hot injection molding, and then the ceramic substrate with groove pattern is obtained after the discharging glue and sintering step.

In some embodiments of the present disclosure, the ceramic substrate can also be prepared by the following steps: S11', preforming a ceramic green body; S12', sintering the ceramic green body; S13', forming a groove on the surface of the sintered ceramic green body through laser carving, then the ceramic substrate is obtained. In other words, the groove can be formed on the surface of ceramic by laser carving, and then the ceramic substrate is obtained.

Specifically, using a method of traditional injection molding or hot injection molding to prepare the ceramic green body, then the ceramic with required shape is obtained after the process of discharging glue and sintering, finally using laser to carve the designed groove pattern on the surface of the ceramic. The condition of the laser carving is well known in the related art, such as the power of the laser is 10-20 W.

In some embodiments of the present disclosure, a depth of the groove on the surface of the ceramic substrate is at least 0.1 mm. In other words, the depth of the groove on the surface of the ceramic substrate is more than 0.1 mm.

After the groove of the ceramic substrate is obtained, then the aforementioned metal melt including zirconium base alloy and the reinforcing material is need to be filled in the groove on the surface of the ceramic substrate surface.

Specifically, as known in the related art, putting the ceramic substrate in a mold, then pressing the metal melt into the groove on the surface of the ceramic substrate using a die casting machine. The condition and method of the die casting process is well known in the related art, for example, the temperature of die casting can be 1000° C., the pressure of die casting can be 10 MPa.

In the process mentioned above, the zirconium base alloy can be used as a binder to combine the reinforcing material with the ceramic substrate. After the reinforcing material is added, the wetting angle between the metal melt and the ceramic substrate becomes small, a bonding force between the metal member which including zirconium base alloy as well as the reinforcing material and the ceramic substrate is much higher than a bonding force between a pure zirconium base alloy and the ceramic substrate.

In some embodiments of the present disclosure, before filling the metal melt in the groove, preheat the ceramic substrate to 500-600° C. in advance. The above step can avoid the property of the prepared metal member to be affected due to the temperature difference between ceramic substrate and metal melt is too large.

In some embodiments of the present disclosure, in step S4, the solidifying step is carried out by cooling, a cooling rate is at least 100 degrees Celsius/minute when a temperature of a product obtained by S3 is above 700 degrees Celsius; a cooling rate is at least 50 degrees Celsius/minute when a temperature of a product obtained by S3 is in a range of 400-700 degrees Celsius. In other words, after the metal melt is filled in the groove, the metal-ceramic composite structure provided by present disclosure can be obtained by cooling the metal melt. The method of above cooling treatment is: a cooling rate is at least 100 degrees Celsius/minute when a temperature is more than 700 degrees Celsius; a cooling rate is at least 50 degrees Celsius/minute when a temperature is in a range of 400-700 degrees Celsius. Thereby, it is helpful to improve the performance of metal-ceramic composite structure.

In order to further improve the appearance property of the prepared metal-ceramic composite structure, it needs to carry out grinding, polishing and sandblasting treatment to the metal-ceramic composite structure. In other words, after the step S4, the method for preparing the metal-ceramic composite structure also includes grinding, polishing and sandblasting treatment. The grinding, polishing and sandblasting treatment is ordinary processing technology, there is no need to be described in detail.

The present disclosure will be described in detail through the following examples.

Example 1

The example is used to illustrate the method for preparing the metal-ceramic composite structure of the present disclosure.

Heat the W powder having a D50 particle size of 1 μm and a thermal expansion coefficient of $4.6\times10^{-6}K^{-1}$ at a temperature of 150° C. for 2 hours, then add the W powder to a molten ZrAlCuNi series alloy at a temperature of 900° C. Stir the above material until to be evenly mixed under an inactive atmosphere, and then a metal melt is obtained, in which, based on a total volume of the metal melt, a volume percentage of W powder is 29%.

Provide a ceramic substrate made of zirconia ceramic, the ceramic substrate has a groove with a depth of 0.2 mm and a width of 0.5 mm, and a thermal expansion coefficient of the ceramic substrate is $10\times10^{-6}K^{-1}$. Preheat the ceramic substrate to 500° C., put the ceramic substrate in a mold, press the above metal melt in the groove on the surface of the ceramic substrate at a temperature of 1000° C. and a pressure of 10 MPa adopting a die casting machine, and the groove is filled to be full.

Then charge the Ar gas and cool quickly, a cooling rate is 120° C./min, take the product out after cooling to a room temperature, carry out grinding, polishing and sand-blasting treatment to the surface of the product, and then a sample S1 of a metal-ceramic composite structure is obtained.

Examples 2-5

These examples are used to illustrate the method for preparing the metal-ceramic composite structure of the present disclosure.

Adopt the same method with Example 1 to prepare samples S2-S5 of the metal-ceramic composite structure.

The different specific parameter is shown in Table 1.

Comparative Example 1

This Comparative Example is used to comparatively describe the metal-ceramic composite structure and the method for preparing the same.

Melt a ZrAlCuNi alloy to obtain a metal melt.

Provide a ceramic substrate made of zirconia ceramic having a groove with a depth of 0.3 mm and a width of 0.5 mm, and a thermal expansion coefficient of the ceramic substrate is $10\times10^{-6}K^{-1}$. Preheat the ceramic substrate to a temperature of 550° C., put it in a mold, press the above metal melt in the groove on the surface of the ceramic substrate at a temperature of 1000° C. and a pressure of 10 MPa adopting a die casting machine, and the groove is filled to be full.

Then charge the Ar gas and cool quickly, a cooling rate is 120° C./min, take the product out after cooling to room temperature, carry out grinding, polishing and sand-blasting treatment to the surface of the product, and then a sample D1 of a metal-ceramic composite structure is obtained.

TABLE 1

| Technical Step | | Example 1 | Example 2 | Example 3 | Example 4 | Example 5 |
|---|---|---|---|---|---|---|
| Forming a groove | Forming Method | Green Body Preforming | Laser Carving | Laser Carving | Green Body Preforming | Green Body Preforming |
| | Depth of the groove/mm | 0.20 | 0.15 | 0.30 | 0.11 | 0.30 |
| Preparing Metal Melt | Reinforcing Material | W | SiC | TiN | $ZrO_2$ | Cr/ZrC |
| | Thermal Expansion Coefficient of Reinforcing Material/$10^{-6}K^{-1}$ | 4.6 | 4.7 | 6.81 | 10 | 6.2/6.7 |
| | Stirring Temperature/° C. | 900 | 1000 | 1100 | 1100 | 900 |
| | Volume Percentage of Reinforcing Material/% | 29 | 5 | 10 | 15 | 25 (Cr/ZrC: 15/10) |
| | Alloy | ZrAlCuNi Series Alloy | ZrAlCuNi Series Alloy | ZrAlCuNi Series Alloy | ZrAlCuNi Series Alloy | ZrAlCuNi Series Alloy |
| | thermal Expansion Coefficient of Alloy/$10^{-6}K^{-1}$ | 9.02 | 9.02 | 9.02 | 9.02 | 9.02 |
| Die Casting | Preheating Temperature of Ceramic/° C. | 500 | 550 | 600 | 600 | 550 |
| | Die Casting Temperature/° C. | 1000 | 1000 | 1000 | 1000 | 1000 |
| | Die Casting Pressure/MPa | 10 | 10 | 10 | 10 | 10 |

Performance Testing

Carry out the following test to the sample S1-S5 and D1 of Example 1-5 and Comparative Example 1, and stainless steel of 310s type, aluminum alloy, zirconium base amorphous alloy, the testing result is shown in Table 2.

1. The bonding force between the metal member and the ceramic substrate:

Preparing a slurry including the reinforcing material of present disclosure, inject the slurry to a zirconia ceramic ring with an internal diameter of 11 mm and a height of 10 mm, and sintering in advance, then the zirconium base amorphous alloy is melted and infiltrated into the zirconia ceramic ring and combining with the reinforcing material, and a testing sample of a zirconia ceramic ring with a core part of the metal member is obtained.

Adopting a universal testing machine push the core part of metal member out, test the required pressure and calculate the shear force, that is the bonding force between the metal member and the ceramic substrate.

2. A hardness of the metal member:

Grinding and polishing the metal member surface of the samples to be a mirror face, then adopt a HVS-10Z type digital display vickers hardness tester to test 10 points, calculate average.

3. Appearance

Observe by naked eye and optical microscope after 50 times magnification, estimate whether there is apparent defection of pit and bulge and so on, and a gloss is whether uniform or not.

4. Brightness

Grinding and polishing the sample surface to be a mirror face, then adopting a color measurement instrument (NC-1101 type) of North Electronic Technology (Kunshan) Co., Ltd to test 10 points, and calculating an average.

TABLE 2

| Sample | Bonding Force/ MPa | Hardness/ Hv | Appearance | Brightness |
|---|---|---|---|---|
| S1 | 52 | 650 | Uniform surface gloss, there is no scotoma defection | 37.69 |
| S2 | 50 | 620 | Uniform surface gloss, there is no scotoma defection | 38.01 |
| S3 | 53 | 600 | Uniform surface gloss, there is no scotoma defection | 37.80 |
| S4 | 51 | 650 | Uniform surface gloss, there is no scotoma defection | 39.75 |
| S5 | 60 | 680 | Uniform surface gloss, there is no scotoma defection | 43.25 |
| D1 | 51 | 430 | Uniform gloss of metal surface, there are much obvious scotoma by naked-eye observation; there are many small pits after 50 times magnification. | 47.64 |
| 310s stainless steel | / | about 190 | / | 49.84 |
| Aluminum Alloy | / | 90-100 | / | 51.81 |
| Zirconium base amorphous alloy | / | Less than 450 | / | 48.74 |

It can be seen from the testing results of Table 2, in the metal-ceramic composite structure prepared by present disclosure, the bonding force between the metal member and the ceramic substrate is strong, the metal member and the ceramic substrate can be combined without slot. The metal member has a high hardness, and is not easy to be abraded, and there is no defection of pores, holes and so on. Moreover the brightness of the metal member surface is high, the appearance is good, and has a mirror effect of a ceramic and a matt effect of a metal, especially adapted to be used as a ceramic article with metal decoration.

Although preferable embodiments of the present disclosure have been described in detail in above, the present disclosure is not limited to specific details in the foregoing embodiments. Various simple variations can be made within the scope of the technical idea of the present disclosure, and such simple variations all fall within the protection scope of the present disclosure.

The invention claimed is:

1. A metal-ceramic composite structure, comprising:

a ceramic substrate, having a groove on a surface of the ceramic substrate; and a metal member, filled in the groove and comprising:

a main body, made of zirconium base alloy;

a reinforcing material, dispersed in the main body, and selected from at least one of W, Mo, Ni, Cr, stainless steel, WC, TiC, SiC, ZrC, $ZrO_2$, BN, $Si_3N_4$, TiN and $Al_2O_3$, and the selected reinforcing material including a carbon element, wherein the reinforcing material and the zirconium base alloy are mixed such that the reinforcing material is dispersed evenly in the zirconium base alloy; a ratio of a volume of the reinforcing material to a total volume of the reinforcing material and the zirconium base alloy is in a predetermined range of 5%-30%, so as to avoid pores formed in the metal member to achieve a desired appearance quality; and the carbon element in the reinforcing material reacts with Zr element in the zirconium base alloy to form a ZrC, so as to improve a bonding force between the zirconium base alloy and the reinforcing material, and a hardness of the metal member is between 600 to 680 Hv.

2. The metal-ceramic composite structure according to claim 1, wherein the reinforcing material has particle shape, and a D50 particle size of the reinforcing material is in a range of 0.1 μm-100 μm.

3. The metal-ceramic composite structure according to claim 1, wherein the zirconium base alloy is a zirconium base amorphous alloy.

4. The metal-ceramic composite structure according to claim 3, wherein the ceramic substrate is a zirconia ceramic.

5. The metal-ceramic composite structure according to claim 1, wherein a depth of the groove is at least 0.1 mm.

* * * * *